US010385458B2

(12) United States Patent
Walter et al.

(10) Patent No.: US 10,385,458 B2
(45) Date of Patent: Aug. 20, 2019

(54) PLATING BATH COMPOSITION AND METHOD FOR ELECTROLESS PLATING OF PALLADIUM

(71) Applicant: Atotech Deutschland GmbH, Berlin (DE)

(72) Inventors: Andreas Walter, Dresden (DE); Katharina Muskulus, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 204 days.

(21) Appl. No.: 15/523,709

(22) PCT Filed: Dec. 17, 2015

(86) PCT No.: PCT/EP2015/080136

§ 371 (c)(1),
(2) Date: May 2, 2017

(87) PCT Pub. No.: WO2016/097083

PCT Pub. Date: Jun. 23, 2016

(65) Prior Publication Data

US 2019/0093235 A1 Mar. 28, 2019

(30) Foreign Application Priority Data

Dec. 17, 2014 (EP) ..... 14198654

(51) Int. Cl.
*C23C 18/44* (2006.01)
*C23C 18/16* (2006.01)

(52) U.S. Cl.
CPC ..... *C23C 18/44* (2013.01); *C23C 18/1651* (2013.01)

(58) Field of Classification Search
None
See application file for complete search history.

(56) References Cited

U.S. PATENT DOCUMENTS 3,961,109 A 6/1976 Kremer et al.
4,415,409 A * 11/1983 Zudkevitch ..... B01D 3/40 203/51
4,424,241 A 1/1984 Abys
5,882,736 A 3/1999 Stein et al.
6,183,545 B1 2/2001 Okuhama et al.
6,235,093 B1 5/2001 Okuhama et al.
9,401,466 B2 * 7/2016 Walter ..... C23C 18/1844
2004/0009292 A1 * 1/2004 Kanzler ..... C23C 18/42 427/97.3
2007/0066059 A1 * 3/2007 Chen ..... C09D 5/10 438/678
2012/0171363 A1 7/2012 Yamamoto et al.
2013/0230657 A1 * 9/2013 Milum ..... C23C 18/31 427/443.1
2017/0121823 A1 * 5/2017 Suchentrunk ..... C23C 18/1637
2017/0321327 A1 * 11/2017 Beck ..... C23C 18/1646
2018/0340260 A1 * 11/2018 Walter ..... C23C 18/1683
2018/0340261 A1 * 11/2018 Walter ..... C23C 18/44

FOREIGN PATENT DOCUMENTS

CN 102912324 2/2013
DE 222346 5/1985
GB 1174851 A * 12/1969
JP 11269658 10/1999
JP 2003268558 9/2003
JP 2007046142 2/2007
WO 2006065221 6/2006
WO WO 2015/155173 A1 * 10/2015

OTHER PUBLICATIONS

Machine translation of Japan 2003-268558, 15 pages, first published in Japanese in Sep. 2003.*
English translation of JPH 11/269658, Oct. 1999; 29 pages.*
English translation of CN 102912324, Feb. 2013; 6 pages.*
PCT/EP2015/080136; PCT International Preliminary Report on Patentability dated May 8, 2017.
PCT/EP2015/080136; PCT International Search Report and Written Opinion of the International Searching Authority dated Mar. 29, 2016.

* cited by examiner

*Primary Examiner* — Helene Klemanski
(74) *Attorney, Agent, or Firm* — Renner, Otto, Boisselle & Sklar, LLP

(57) ABSTRACT

The present invention relates to an aqueous plating bath composition and a method for depositing a palladium layer by electroless plating onto a substrate. The aqueous plating bath composition according to the present invention comprises a source for palladium ions, a reducing agent for palladium ions and an aromatic compound. The aqueous plating bath composition has an increased deposition rate for palladium while maintaining bath stability. The aqueous plating bath composition has also a prolonged life time. The aromatic compounds of the present invention allow for adjusting the deposition rate to a constant range over the bath life time and for electrolessly depositing palladium layers at lower temperatures. The aromatic compounds of the present invention activate electroless palladium plating baths having a low deposition rate and reactivate aged electroless palladium plating baths.

16 Claims, 2 Drawing Sheets

PLATING BATH COMPOSITION AND METHOD FOR ELECTROLESS PLATING OF PALLADIUM

The present application is a U.S. National Stage Application based on and claiming benefit and priority under 35 U.S.C. § 371 of International Application No. PCT/EP2015/080136, filed 17 Dec. 2015, which in turn claims benefit of and priority to European Application No. 14198654.7 filed 17 Dec. 2014, the entirety of both of which is hereby incorporated herein by reference.

FIELD OF THE INVENTION

The present invention relates to aqueous plating bath compositions and methods for electroless plating of palladium in the manufacture of printed circuit boards, IC substrates and for metallization of semiconductor wafers.

BACKGROUND OF THE INVENTION

Electroless deposition of palladium in the manufacture of printed circuit boards, IC substrates and the like as well as metallization of semiconductor wafers is an established technique. The palladium layers are used for example as barrier layers and/or wire-bondable and solderable finishes.

Electroless palladium plating bath compositions comprising a source for palladium ions, a nitrogenated complexing agent and a reducing agent selected from formic acid and derivatives thereof are disclosed in U.S. Pat. No. 5,882,736. Such electroless palladium plating bath compositions are suited to deposit pure palladium in contrast to plating bath compositions containing hypophosphite as reducing agent which result in palladium-phosphorous alloy layers.

Patent application WO 2006/065221 A1 discloses an autocatalytic electroless plating bath for plating a metal, i.a., palladium, comprising a surfactant, i.a., nonylphenol ethoxylate, and a reducing agent, i.a., hydrazine or formaldehyde. When operated above the cloud point, the bath containing the surfactant leads to controlled deposition of the metal, reduced decomposition of the bath and provides high plating speed at very low concentrations of metal.

Patent application DD 222 346 A1 discloses a solution for autocatalytic deposition of palladium comprising a palladium compound, a reducing agent, complexing agents, stabilizers and nonylphenol as a surfactant. Addition of nitroso naphthols results in improved stability of the solution.

U.S. Pat. No. 4,424,241 describes an electroless plating solution comprising palladium, organic ligands and reducing agents, i.a. formaldehyde and formic acid. Certain additives, i.a. phenolphthalein, may be added to improve the appearance and properties of the plated palladium.

Although much of the prior art literature teaches palladium plating bath compositions, the plating rates obtained therewith cannot satisfy the current need for steadily increasing plating rates that are required in order to achieve economic manufacturing.

Further, the deposition rate constantly decreases during bath life and a deposition rate too low finally terminates the life time of an electroless palladium plating bath. This is due to the catalytic effect of already deposited palladium and the autocatalytic deposition mechanism. Usually, changing the temperature of an electroless palladium plating bath is used for regulating the deposition rate and duration of bath life. Increasing the bath temperature also increases the deposition rate. But operating the bath at a higher temperature simultaneously increases the risk of destabilising the bath.

The stability of such a plating bath means that the plating bath is stable against decomposition, i.e. the undesired precipitation of metallic palladium in the plating bath itself. Accordingly, destabilising an electroless palladium plating bath in turn shortens the bath life. Due to the high price of palladium early discarding of an electroless palladium plating bath is undesired for economic reasons as well.

OBJECTIVE OF THE PRESENT INVENTION

It is an objective of the present invention to provide a plating bath composition and a method for electroless plating of palladium wherein the deposition rate is further increased. It is a further objective of the present invention to provide a plating bath composition and a method for electroless plating of palladium which allow for adjusting the deposition rate to the desired high value. It is a further objective of the present invention to provide a plating bath composition and a method for electroless plating of palladium wherein the deposition rate is further increased while the bath remains still stable. It is a particular objective of the present invention to provide a plating bath composition and a method for electroless plating of palladium which allow for maintaining a constant high deposition rate during the life time of the plating bath. It is a further objective of the present invention to provide a plating bath composition and a method for electroless plating of palladium which allow for increasing the life time of the plating bath.

SUMMARY OF THE INVENTION

These objectives are solved with an aqueous plating bath composition for electroless deposition of palladium, comprising (i) at least one source for palladium ions, (ii) at least one reducing agent for palladium ions, and (iii) at least one aromatic compound according to Formula (I)

Formula (I)

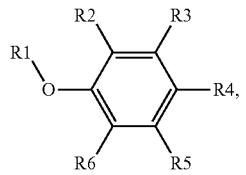

wherein R1 is selected from the group consisting of —H, —$CH_3$, and —$CH_2$—$CH_3$; and wherein R4 is selected from the group consisting of a substituted, linear C1 to C8 alkyl group; unsubstituted or substituted, branched C3 to C8 alkyl group; and an unsubstituted or substituted carbonyl group; and wherein R2, R3, R5, and R6 are selected independently from each other from the group consisting of —H; unsubstituted or substituted, linear C1 to C20 alkyl group; unsubstituted or substituted, branched C3 to C20 alkyl group; —OH; —O—$CH_3$; —O—$CH_2$—$CH_3$; —$CH_3$ and —CHO.

These objectives are further solved by a method for electroless palladium plating comprising the steps of (a) providing a substrate, (b) contacting the substrate with the aqueous plating bath composition as described above and thereby depositing a layer of palladium onto at least a portion of the substrate.

The aqueous plating bath composition according to the present invention is called the composition or the composition according to the present invention herein. The terms "plating" and "depositing" are used interchangeably herein.

The aromatic compounds according to Formula (I) provide the aqueous plating bath composition according to the present invention with an increased deposition rate for palladium, in particular for pure palladium, and a prolonged life time. Although increasing the deposition rate, the aromatic compounds according to Formula (I) do not impair the stability of the aqueous plating bath composition according to the present invention against undesired decomposition. Adding the aromatic compounds according to Formula (I) to an electroless palladium plating bath allows for adjusting the deposition rate to a constant range over the bath life time. The aromatic compounds according to Formula (I) of the present invention activate electroless palladium plating baths having a low deposition rate even when freshly prepared and reactivate aged electroless palladium plating baths.

The aromatic compounds according to Formula (I) of the present invention allow for electrolessly depositing palladium layers at lower temperatures.

DETAILED DESCRIPTION OF THE INVENTION

Figure 1:
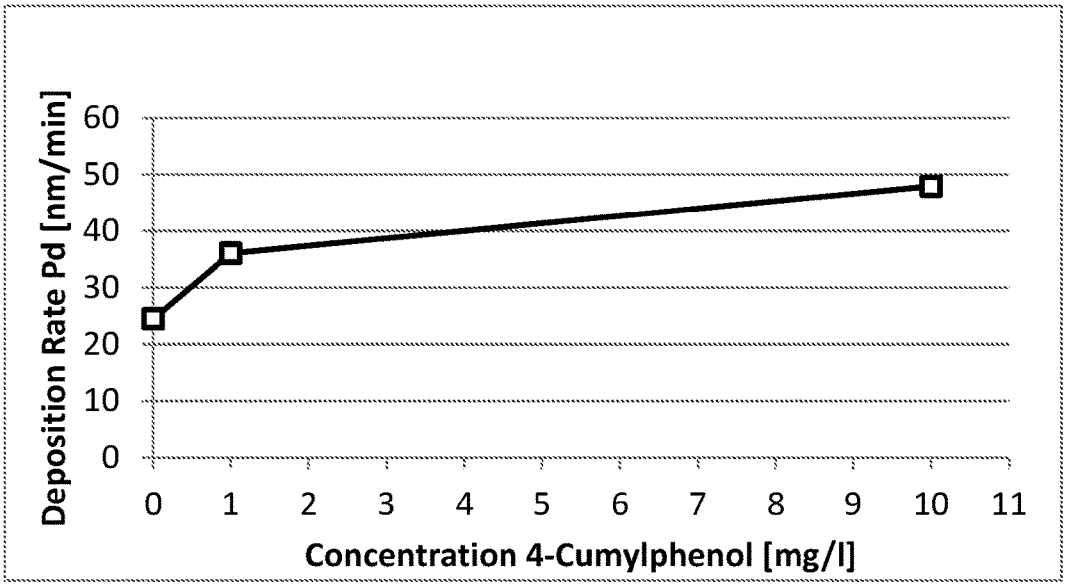
FIG. 1 shows the deposition rate of an aqueous plating bath composition containing 4-cumylphenol in a concentration range of 1 to 10 mg/l.

The aqueous plating bath composition comprises (iii) at least one aromatic compound according to Formula (I)

Formula (I)

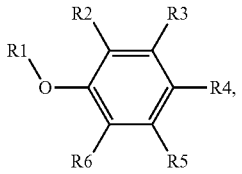

wherein R1 is selected from the group consisting of —H, —$CH_3$, and —$CH_2$—$CH_3$; and wherein R4 is selected from the group consisting of a substituted, linear C1 to C8 alkyl group; unsubstituted or substituted, branched C3 to C8 alkyl group; and an unsubstituted or substituted carbonyl group; and wherein R2, R3, R5, and R6 are selected independently from each other from the group consisting of —H; unsubstituted or substituted, linear C1 to C20 alkyl group; unsubstituted or substituted, branched C3 to C20 alkyl group; —OH; —O—$CH_3$; —O—$CH_2$—$CH_3$; —$CH_3$ and —CHO.

In one embodiment R1 preferably is —H.

In another embodiment the substituted, linear alkyl group of R4 is preferably selected from a substituted, linear C1 to C5 alkyl group; even more preferably from a substituted n-pentyl group, n-butyl group, n-propyl group, ethyl group and methyl group; most preferably a substituted n-propyl group, ethyl group and methyl group.

In another embodiment the unsubstituted or substituted, branched alkyl group of R4 is preferably selected from an unsubstituted or substituted, branched C3 to C5 alkyl group; even more preferably from 2-pentyl (sec-pentyl) group, 3-pentyl group, 2-methylbutyl group, 3-methylbutyl (iso-pentyl) group, 3-methylbut-2-yl group, 2-methylbut-2-yl group, 2,2-dimethylpropyl (neo-pentyl) group, iso-butyl group, sec-butyl group, tert-butyl group, iso-propyl group; most preferably from 2-pentyl (sec-pentyl) group, 3-pentyl group, 3-methylbut-2-yl group, 2-methylbut-2-yl group, 2,2-dimethylpropyl, sec-butyl group, tert-butyl group, and iso-propyl group.

Preferably, the unsubstituted or substituted carbonyl group of R4 is selected from moieties according to —$(CR7R8)_n$-CO—$(CR9R10)_m$-R11; wherein R7, R8, R9, R10 are selected independently of each other from —H, —$CH_3$, —$CH_2$—$CH_3$, —OH, —O—$CH_3$, —O—$CH_2$—$CH_3$; more preferably from —H, —$CH_3$, —OH, —O—$CH_3$; even more preferably from —H;

wherein R11 is selected from the group comprising —H, —$CH_3$, —$CH_2$—$CH_3$, —OH, —O—$CH_3$, —O—$CH_2$—$CH_3$, an unsubstituted or substituted phenyl group and an unsubstituted or substituted naphthyl group; more preferably —$CH_3$, —OH, —O—$CH_3$, an unsubstituted or substituted phenyl group and an unsubstituted or substituted naphthyl group; even more preferably an unsubstituted or substituted phenyl group; and wherein n, m are integers selected independently of each other from 0, 1 and 2; more preferably from 0 and 1; most preferably from 0.

More preferably, the phenyl group or the naphthyl group of R11 are substituted. Even more preferably, the substituents are selected independently from each other from the group consisting of —OH, —O—$CH_3$, —O—$CH_2$—$CH_3$, —$CH_3$, and —CHO; yet even more preferably —OH, —O—$CH_3$, —O—$CH_2$—$CH_3$, and —$CH_3$; most preferably —OH.

In another embodiment the unsubstituted or substituted, linear alkyl group of R2, R3, R5, and/or R6 is preferably selected from an unsubstituted or substituted, linear C1 to C8 alkyl group; more preferably from an unsubstituted or substituted, linear C1 to C5 alkyl group; even more preferably from a n-pentyl group, n-butyl group, n-propyl group, ethyl group and methyl group; most preferably n-propyl group, ethyl group and methyl group.

In another embodiment the unsubstituted or substituted, branched alkyl group of R2, R3, R5, and/or R6 is preferably selected from an unsubstituted or substituted, branched C3 to C8 alkyl group; more preferably from an unsubstituted or substituted, branched C3 to C5 alkyl group; even more preferably from 2-pentyl (sec-pentyl) group, 3-pentyl group, 2-methylbutyl group, 3-methylbutyl (iso-pentyl) group, 3-methylbut-2-yl group, 2-methylbut-2-yl group, 2,2-dimethylpropyl (neo-pentyl) group, iso-butyl group, sec-butyl group, tert-butyl group, iso-propyl group; most preferably from 2-pentyl (sec-pentyl) group, 3-pentyl group, 3-methylbut-2-yl group, 2-methylbut-2-yl group, 2,2-dimethylpropyl, sec-butyl group, tert-butyl group, and iso-propyl group.

In a further embodiment the linear alkyl groups or the branched alkyl groups of R2, R3, R5, and/or R6 as defined in the above-mentioned embodiments are substituted. Preferably, the substituents of the linear alkyl groups or the branched alkyl groups of R4, R2, R3, R5, and/or R6 are selected independently from each other from the group comprising an unsubstituted or substituted phenyl group and an unsubstituted or substituted naphthyl group; more preferably an unsubstituted or substituted phenyl group.

In a preferred embodiment, the substituents of the linear alkyl groups or the branched alkyl groups of R4, R2, R3, R5, and/or R6, namely the unsubstituted or substituted phenyl group, or the unsubstituted or substituted naphthyl group are not in conjugation with the aromatic ring of the at least one aromatic compound according to Formula (I).

In a further embodiment, the substituents of the linear alkyl groups or the branched alkyl groups of R4, R2, R3, R5, and/or R6, namely the phenyl group or the naphthyl group are substituted. Preferably, the substituents are selected independently from each other from the group consisting of —OH, —O—$CH_3$, —O—$CH_2$—$CH_3$, —$CH_3$, and —CHO; more preferably —OH, —O—$CH_3$, —O—$CH_2$—$CH_3$, and —$CH_3$, most preferably —OH.

In a preferred embodiment the at least one aromatic compound is selected from compounds according to Formula (I) wherein R4 is selected from the group consisting of —$C(CH_3)_3$ (tert-butyl group),

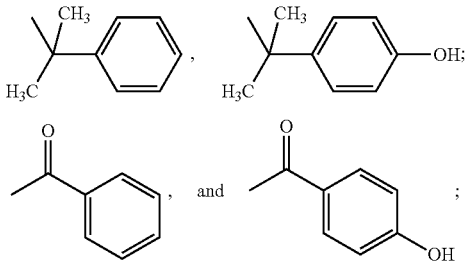

more preferred —$C(CH_3)_3$ (tert-butyl group),

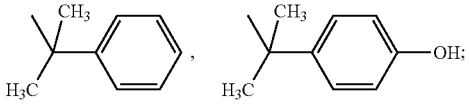

and wherein R2, R3, R5, and R6 are selected independently from each other from the group consisting of —H, —OH; —O—$CH_3$; —O—$CH_2$—$CH_3$; —CHO; —$C(CH_3)_3$ (tert-butyl group),

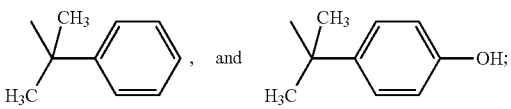

more preferred —H, —OH; —O—$CH_3$; —O—$CH_2$—$CH_3$; —$C(CH_3)_3$ (tert-butyl group),

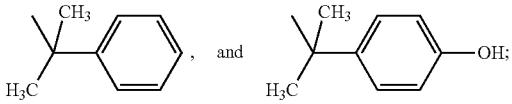

even more preferred —H, —OH; —$C(CH_3)_3$ (tert-butyl group),

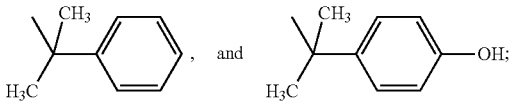

and wherein R1 is selected from the group consisting of —H, —$CH_3$, and —$CH_2$—$CH_3$, preferably —H.

In a further preferred embodiment the at least one aromatic compound is selected from compounds according to Formula (I) wherein the aromatic compound has only one substituent in addition to the group —O—R1, and the only one substituent is bound to the aromatic ring in para-position to the group —O—R1. Thus, the at least one aromatic compound is selected from compounds according to Formula (I)

wherein R2, R3, R5, and R6 are —H; and wherein R1 is selected from the group consisting of —H, —$CH_3$, and —$CH_2$—$CH_3$, preferably —H; and wherein R4 is selected from the group consisting of a substituted, linear C1 to C8 alkyl group; and unsubstituted or substituted, branched C3 to C8 alkyl group; and an unsubstituted or substituted carbonyl group; preferably

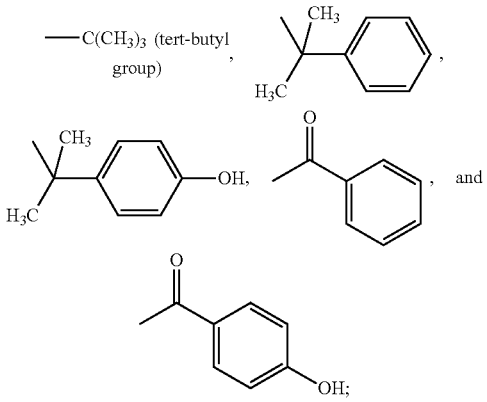

more preferably

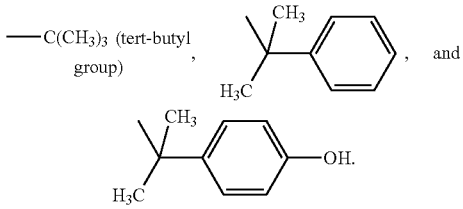

In a further preferred embodiment the at least one aromatic compound according to Formula (I) is selected from the group comprising 4-(1,1-Dimethylethyl)phenol (4-tert-butylphenol); p-Hydroxy-2,2-diphenylpropane (4-Cumylphenol); 4-[2-(4-hydroxyphenyl)propan-2-yl]phenol (Bisphenol A); 1,1-Bis(4-hydroxyphenyl)-1-phenylethane (Bisphenol AP); 2,2-Bis(4-hydroxy-phenyl)butane (Bisphenol B); Bis-(4-hydroxyphenyl)diphenylmethane (Bisphenol BP); 2,2-Bis(3-methyl-4-hydroxyphenyl)propane (Bisphenol C); 1,1-Bis(4-hydroxyphenyl)ethane (Bisphenol E); Bis (4-hydroxyphenyl)methane (Bisphenol F); (4-Hydroxyphenyl)(phenyl)methanone and Bis(4-hydroxyphenyl)-methanone; more preferably Phenol; 4-(1,1-Dimethylethyl) phenol; p-Hydroxy-2,2-diphenylpropane; 4-[2-(4-hydroxyphenyl)propan-2-yl]phenol, (4-Hydroxyphenyl) (phenyl)methanone and Bis(4-hydroxyphenyl)-methanone.

In so far as the term "alkyl" is used in this description and in the claims, it refers to a hydrocarbon radical with the general chemical formula $C_nH_{2n+1}$, n being an integer from 1 to 20. Alkyl residues according to the present invention can be linear and/or branched and they are preferably saturated. For example, a linear C1 to C20 alkyl group means a linear alkyl group having a number of overall C atoms ranging from 1 to 20, respectively. A branched C3 to C20 alkyl group means a branched alkyl group in which the sum of C atoms in the main chain plus C atoms in the branching chains results in a number of overall C atoms ranging from 3 to 20, respectively. A linear C1 to C8 alkyl group or a branched C3 to C8 alkyl group for example includes methyl, ethyl, propyl, butyl, pentyl, hexyl, heptyl or octyl. A linear C1 to C5 alkyl group or a branched C3 to C5 alkyl group for example includes methyl, ethyl, propyl, butyl, or pentyl. Alkyl can be substituted by replacing an H-atom in each case by a substituent as outlined above for R4, R2, R3, R5, and/or R6.

In so far as the term "aryl" is used in this description and in the claims, it refers to ring-shaped aromatic hydrocarbon radicals, for example phenyl or naphthyl. Furthermore, aryl can be substituted by replacing an H-atom in each case by a substituent as outlined above for phenyl and/or naphthyl groups.

Preferably, the at least one aromatic compound according to Formula (I) has a concentration in the aqueous plating bath composition according to the present invention ranging from 0.01 to 100 mg/l; preferably from 0.1 to 50 mg/l; more preferably from 0.1 to 20 mg/l; even more preferably from 0.1 to 10 mg/l.

The aqueous plating bath composition according to the present invention comprises at least one source for palladium ions. Preferably, the at least one source for palladium ions is a water soluble palladium compound. More preferably, the at least one source for palladium ions is selected from the group comprising palladium chloride, palladium acetate, palladium sulfate and palladium perchlorate. Optionally, complex compounds comprising a palladium ion and a complexing agent, preferably a nitrogenated complexing agent, for palladium ions can be added to the plating bath instead of forming such a complex compound in the plating bath by adding a palladium salt and said complexing agent for palladium ions to the plating bath as separate ingredients. Suitable complex compounds as sources for palladium ions are for example complex compounds comprising palladium ions and complexing agents; preferably nitrogenated complexing agents; more preferably ethane-1,2-diamine and/or alkyl substituted ethane-1,2-diamines. Suitable complex compounds may further comprise counter ions to palladium ions; preferably chloride, acetate, sulfate or perchlorate. Suitable nitrogenated complexing agents and alkyl substituted ethane-1,2-diamines are defined below as complexing agents. Preferably, suitable complex compounds as sources for palladium ions are for example dichloro ethane-1,2-diamine palladium, diacetato ethane-1,2-diamine palladium; dichloro $N^1$-methylethane-1,2-diamine palladium; diacetato $N^1$-methylethane-1,2-diamine; dichloro $N^1$,$N^2$-dimethylethane-1,2-diamine; diacetato $N^1$,$N^2$-dimethylethane-1,2-diamine; dichloro $N^1$-ethylethane-1,2-diamine; diacetato $N^1$-ethylethane-1,2-diamine, dichloro $N^1$,$N^2$-diethylethane-1,2-diamine; and diacetato $N^1$,$N^2$-diethylethane-1,2-diamine.

The concentration of palladium ions in the composition ranges from 0.5 to 500 mmol/l, preferably from 1 to 100 mmol/l.

The aqueous plating bath composition according to the present further comprises at least one reducing agent for palladium ions. The reducing agent makes the plating bath an autocatalytic, i.e. an electroless plating bath. Palladium ions are reduced to metallic palladium in the presence of said reducing agent. This plating mechanism differentiates the plating bath according to the present invention from 1) immersion-type palladium plating baths which do not contain a reducing agent for palladium ions and 2) plating baths for electroplating of palladium which require an external electrical current in order to deposit a palladium layer.

The at least one reducing agent is preferably a chemical reducing agent. Reducing agents provide the electrons necessary to reduce metal ions to their metallic form and thereby form a metal deposit on a substrate.

More preferably, the at least one reducing agent is a reducing agent for depositing pure palladium deposits. Pure palladium deposits are deposits containing palladium in an amount ranging from 98.0 to 99.99 wt.-% or higher, preferably from 99.0 to 99.99 wt.-% or higher.

Even more preferably, the at least one reducing agent for palladium ions is selected from the group consisting of hydrazine, formaldehyde, formic acid, derivatives of the aforementioned and salts of formic acid.

Yet even more preferably, the at least one reducing agent for palladium ions is selected from the group consisting of formic acid, derivatives of formic acid and salts of the aforementioned. Yet even more preferably, the formic acid derivatives are selected from esters of formic acid. Yet even more preferably, esters of formic acid are selected from the group consisting of formic acid methylester, formic acid ethylester and formic acid propylester. Suitable counter ions for salts of formic acid are for example selected from hydrogen, lithium, sodium, potassium and ammonium. The aqueous plating bath composition according to the present invention is particularly suitable for depositing palladium layers in the presence of formic acid, derivatives and salts of the aforementioned as reducing agent.

Preferably, the concentration of the at least one reducing agent in the aqueous plating bath composition according to the present invention ranges from 10 to 1000 mmol/l.

The aqueous plating bath composition of the present invention is particularly suitable for depositing pure palladium layers. Pure palladium layers are particularly suitable for high temperature applications like in motor control units as pure palladium layers allow for sufficient thermal stability of bonded or soldered connections.

Hypophosphite ions and/or amine borane compounds and/or sodium borohydride are not suitable as the reducing agent because palladium alloy layers are deposited from such plating bath compositions.

The aqueous plating bath composition according to the present invention may further comprise at least one complexing agent for palladium ions. A complexing agent (sometimes also referred to as chelating agent) keeps metal ions dissolved and prevents their undesired precipitation from solution.

Preferably, the at least one complexing agent is a nitrogenated complexing agent for palladium ions. More preferably, the at least one nitrogenated complexing agent is selected from the group comprising primary amines, secondary amines and tertiary amines. Even more preferably, the at least one nitrogenated complexing agent is selected from the group comprising diamines, triamines, tetraamines and higher homologues thereof.

Suitable amines are for example ethane-1,2-diamine ($NH_2$—$CH_2$—$CH_2$—$NH_2$, ethylene diamine); alkyl substituted ethane-1,2-diamines; 1,3-diamino-propane; 1,2-bis (3-amino-propyl-amino)-ethane; diethylene-triamine; diethylene-triamine-penta-acetic acid; N-(2-hydroxy-ethyl)-ethylene-diamine; ethylene-diamine-N,N-diacetic acid; 1,2-diamino-propyl-amine; 1,3-diamino-propyl-amine; 3-(methyl-amino)-propyl-amine; 3-(dimethyl-amino)-propyl-amine; 3-(diethyl-amino)-propyl-amine; bis-(3-amino-propyl)-amine; 1,2-bis-(3-amino-propyl)-alkyl-amine; diethylene-triamine; triethylene-tetramine; tetra-ethylene-pentamine; penta-ethylene-hexamine and mixtures thereof.

Suitable alkyl substituted ethane-1,2-diamines are for example $N^1$-methylethane-1,2-diamine ($CH_3$—NH—$CH_2$—$CH_2$—$NH_2$); $N^1$,$N^2$-dimethylethane-1,2-diamine ($CH_3$—NH—$CH_2$—$CH_2$—NH—$CH_3$); $N^1$,$N^1$-dimethylethane-1,2-diamine ($(CH_3)_2$—N—$CH_2$—$CH_2$—$NH_2$); $N^1$,$N^1$,$N^2$-trimethylethane-1,2-diamine ($(CH_3)_2$—N—$CH_2$—$CH_2$—NH—$CH_3$); $N^1$,$N^1$,$N^2$,$N^2$-tetramethylethane-1,2-diamine ($(CH_3)_2$—N—$CH_2$—$CH_2$—N—$(CH_3)_2$); $N^1$-ethylethane-1,2-diamine ($C_2H_5$—NH—$CH_2$—$CH_2$—$NH_2$); $N^1$,$N^2$-diethylethane-1,2-diamine ($C_2H_5$—NH—$CH_2$—$CH_2$—NH—$C_2H_5$); $N^1$-ethyl-$N^2$-methylethane-1,2-diamine ($C_2H_5$—NH—$CH_2$—$CH_2$—NH—$CH_3$); $N^1$-ethyl-$N^1$-methylethane-1,2-diamine ($(CH_3)(C_2H_5)$—N—$CH_2$—$CH_2$—$NH_2$); $N^1$,$N^1$-diethylethane-1,2-diamine ($(C_2H_5)_2$—N—$CH_2$—$CH_2$—$NH_2$); $N^1$-ethyl-$N^1$,$N^2$-dimethylethane-1,2-diamine ($(CH_3)(C_2H_5)$—N—$CH_2$—$CH_2$—NH—$CH_3$); $N^1$,$N^2$-diethyl-$N^1$-methylethane-1,2-diamine ($(CH_3)(C_2H_5)$—N—$CH_2$—$CH_2$—NH—$(C_2H_5)$); $N^1$,$N^1$-diethyl-$N^2$-methylethane-1,2-diamine ($(C_2H_5)_2$—N—$CH_2$—$CH_2$—NH—$CH_3$); $N^1$,$N^1$,$N^2$-triethylethane-1,2-diamine ($(C_2H_5)_2$—N—$CH_2$—$CH_2$—NH—$C_2H_5$); $N^1$-ethyl-$N^1$,$N^2$,$N^2$-trimethylethane-1,2-diamine ($(CH_3)(C_2H_5)$—N—$CH_2$—$CH_2$—N—$(CH_3)_2$); $N^1$,$N^2$-diethyl-$N^1$,$N^2$-dimethylethane-1,2-diamine ($(CH_3)(C_2H_5)$—N—$CH_2$—$CH_2$—N—$(CH_3)(C_2H_5)$); $N^1$,$N^1$-diethyl-$N^2$,$N^2$-dimethylethane-1,2-diamine ($(C_2H_5)_2$—N—$CH_2$—$CH_2$—N—$(CH_3)_2$); $N^1$,$N^1$,$N^2$-triethyl-$N^2$-methylethane-1,2-diamine ($(C_2H_5)_2$—N—$CH_2$—$CH_2$—N—$(CH_3)(C_2H_5)$); $N^1$,$N^1$,$N^2$,$N^2$-tetraethylethane-1,2-diamine ($(C_2H_5)_2$—N—$CH_2$—$CH_2$—N—$(C_2H_5)_2$) and mixtures thereof.

Preferably, the mole ratio of the complexing agent for palladium ions and palladium ions in the composition according to the present invention ranges from 1:1 to 50:1.

The aqueous plating bath composition according to the present invention may further comprise at least one stabilizing agent. Stabilizing agents, also referred to as stabilizers, are compounds that stabilize an electroless metal plating solution against undesired outplating in the bulk solution and spontaneous decomposition. The term "outplating" means undesired and/or uncontrolled deposition of the metal on surfaces other than substrate surfaces.

The at least one stabilizing agent may be selected from the group comprising compounds of the elements selenium, tellurium, copper, nickel, and iron and/or mercapto-benzothiazole, seleno-cyanates, thiourea, saccharin, ferro-cyanates; 4-nitrobenzoic acid; 3,5-dinitrobenzoic acid; 2,4-dinitrobenzoic acid; 2-hydroxy-3,5-dinitrobenzoic acid; 2-acetylbenzoic acid; 4-nitrophenol and their corresponding ammonium, sodium and potassium salts.

Preferably, the concentration of such further stabilizing agents in the composition according to the present invention ranges from 0.01 to 500 mg/l, more preferably from 0.1 to 200 mg/l, even more preferably from 1 to 200 mg/l, and most preferably from 10 to 100 mg/l.

Preferably, the aqueous plating bath composition according to the present invention is an acidic plating bath. The pH-value of the aqueous plating bath composition more preferably ranges from 4 to 7 because the composition is unstable at a pH-value below 4. Even more preferably, the pH-value of the composition ranges from 5 to 6. At pH-values above 7, the composition is prone to deposit palladium onto the substrate by immersion-type plating resulting in a weak adhesion between the palladium layer and the underlying substrate. Furthermore, a plating bath composition having a pH-value above 7 would attack organic resist materials such as solder mask materials which may also be a part of the substrate.

The present invention further relates to a method for electroless palladium plating comprising the steps of a) providing a substrate, b) contacting the substrate with the aqueous plating bath composition according to the present invention and thereby depositing a layer of palladium onto at least a portion of the substrate.

Preferably, the method steps are performed in the order described above. Preferably, the substrate has a metal surface.

Palladium plating or deposition of palladium is preferably carried out by contacting a substrate having a metal surface with the composition according to the present invention and thereby depositing a layer of palladium onto at least a portion of the metal surface of the substrate. Preferably, the metal surface or the portion thereof to be coated with palladium is selected from the group comprising copper, copper alloys, nickel, nickel alloys, cobalt, cobalt alloys, platinum, platinum alloys, gold, gold alloys, and gallium arsenide. The metal surface or the portion thereof to be coated is for example part of a printed circuit board, an IC substrate or a semiconducting wafer. Palladium layers are used for example on semiconducting wafers as noble metal, wire-bondable and solderable finishes of semiconductor chips, light emitting diodes (LED) or solar cells.

Suitable methods for contacting the substrate with the aqueous plating bath composition are for example dipping the substrate into the composition or spraying the composition onto the substrate.

Preferably, the substrate is contacted with the aqueous plating bath composition according to step b) at a temperature of 30 to 95° C., more preferably of 30 to 85° C., even more preferably of 50 to 85° C., yet even more preferably of 30 to 65° C. Preferably, the substrate is contacted with the composition for 1 to 60 min, more preferably 10 to 20 min. Preferably, the substrate is contacted with the aqueous plating bath composition to give a palladium plated layer ranging in thickness from 0.01 to 5.0 μm, more preferably from 0.02 to 2.0 μm and even more preferably from 0.05 to 0.5 μm.

The thickness of palladium layers was measured by x-ray fluorescence (XRF) which is well known to persons skilled in the art. The XRF measurements make use of the characteristic fluorescence radiation emitted from a sample (substrate, deposit) being excited with x-rays. By evaluating the wavelength and intensities and assuming a layered structure of the sample, layer thicknesses can be calculated.

In one embodiment of the present invention, a thin activation layer of palladium is first deposited onto the substrate, preferably a substrate having a metal surface, by an immersion-type plating method (exchange reaction) followed by palladium deposition from the aqueous plating bath composition according to the present invention.

Activation methods for the metal surface prior to electroless palladium deposition are known in the art and can be applied to work within the present invention. A suitable aqueous activation bath may comprise a palladium salt such as palladium acetate, palladium sulfate and palladium nitrate, a complexing agent for palladium ions such as primary amines, secondary amines, tertiary amines and ethanolamines and an acid such as nitric acid, sulfuric acid and methane sulfonic acid. Optionally, such an activation bath further contains an oxidizing agent such as nitrate ions, perchlorate ions, chlorate ions, perborate ions, periodate ions, peroxo-disulfate ions and peroxide ions.

The concentration of the palladium salt in the aqueous activation bath ranges from 0.005 to 20 g/l, preferably from 0.05 to 2.0 g/l. The concentration of the complexing agent for palladium ions ranges from 0.01 to 80 g/l, preferably from 0.1 to 8 g/l.

The pH-value of the aqueous activation bath preferably ranges from 0 to 5, preferably from 1 to 4.

Typically, the substrates are immersed in the aqueous activation bath at 25 to 30° C. for one to four minutes. Prior to immersing the substrate in an aqueous activation bath, the metal surface of the substrate is cleaned. For this purpose, etch cleaning is usually carried out in oxidizing, acidic solutions, for example a solution of sulfuric acid and hydrogen peroxide. Preferably, this is followed by another cleaning in an acidic solution, such as, for example, a sulfuric acid solution.

The aromatic compounds according to Formula (I) of the present invention increase the deposition rate of aqueous plating bath compositions for electroless deposition of palladium, in particular for electroless deposition of pure palladium. Thus, the aqueous plating bath compositions are activated and the deposition process is accelerated. This contributes to acceleration of the manufacturing process.

The deposition rate of known electroless palladium deposition baths usually constantly decreases during bath life. Thus, a longer plating time is required to obtain palladium layers of the same thickness and quality when plating with an aged palladium deposition bath compared to a freshly prepared palladium deposition bath. Adding the aromatic compounds according to Formula (I) to an electroless palladium plating bath allows for adjusting the deposition rate to a constant range over the bath life time, in particular to a constant high range of deposition rate over the bath life. This ensures depositing palladium layers of constant thickness throughout the life time of an electroless palladium plating bath and facilitates process control of the manufacturing process.

If the deposition rate of known electroless palladium deposition baths becomes too low the deposition bath is no more suited for depositing palladium and has to be discarded. Adjusting the deposition rate to a constant range over the bath life time, in particular to a constant high range, also prolongs the life time of an electroless palladium plating bath.

In addition, the aromatic compounds according to Formula (I) of the present invention activate electroless palladium plating baths having a low deposition rate even when freshly prepared. Further, the aromatic compounds according to Formula (I) of the present invention reactivate aged electroless palladium plating baths. Aged electroless palladium plating bath means herein an electroless palladium plating bath already used for plating and whose deposition rate already dropped during such usage. Reactivating means herein that the aromatic compounds according to Formula (I) also increase the deposition rate of an aged electroless palladium plating bath.

For known electroless palladium plating baths and deposition methods, regulating the deposition rate and duration of bath life is achieved by increasing the bath temperature to between 55 to 95° C. during deposition. But a raised temperature of the electroless palladium plating baths has several disadvantages. Operating the bath at a higher temperature increases the risk of destabilising the bath. It requires higher energy consumption. It is of disadvantage for layers of some metals also present on the substrate to be plated. For example, aluminium or copper layers suffer corrosion when present on a substrate which is plated with palladium from a deposition bath at higher temperatures. The aromatic compounds according to Formula (I) of the present invention allow for electrolessly depositing palladium layers at lower temperatures ranging from 30 to 65° C. Thus, stability of the aqueous plating bath compositions of the present invention is maintained and corrosion of metal layers also present on the substrate during deposition of palladium from the composition is prevented.

The present invention further relates to a method for adjusting the deposition rate to a constant range over life time of any aqueous electroless palladium deposition bath, the method comprises the steps of c) providing any aqueous electroless palladium deposition bath, and d) adding at least one aromatic compound according to Formula (I) as defined above to the electroless palladium deposition bath.

The electroless palladium deposition bath may be any aqueous electroless palladium deposition bath. In one embodiment the electroless palladium deposition bath is the aqueous plating bath composition according to the present invention.

In one embodiment of the present invention the electroless palladium deposition bath may be a freshly prepared electroless palladium deposition bath.

In another embodiment the electroless palladium deposition bath may be already used for some time for plating.

Further, in a preferred embodiment, the electroless palladium deposition bath is a bath for electroless deposition of pure palladium.

The deposition rate or the concentration of the at least one aromatic compound according to Formula (I) may be determined during plating or storage. If the deposition rate or the concentration of the at least one aromatic compound according to Formula (I) are below a threshold value, the at least one aromatic compound according to Formula (I) is replenished. Replenishment is performed by adding the at least one aromatic compound according to Formula (I) to the electroless palladium deposition baths.

The at least one aromatic compound according to Formula (I) may be added as a solid or a powder or may be dissolved in a solvent prior to its addition to the electroless palladium deposition baths. Examples for suitable solvents are water; acids like sulphuric acid, hydrochloric acid, phosphoric acid;

alkaline solutions like solutions of sodium hydroxide or potassium hydroxide; and organic solvents like propanol, ethanol, methanol.

In another preferred embodiment the electroless palladium deposition bath may be already used for some time for plating and the deposition rate has dropped in relation to the initial deposition rate. In this embodiment, the present invention relates to a method for reactivating the aqueous electroless palladium deposition bath, the method comprises the steps of e) providing an already used aqueous electroless palladium deposition bath, wherein its deposition rate has dropped in relation to its initial deposition rate, and
f) adding at least one aromatic compound according to Formula (I) as defined above, and thereby increasing its deposition rate.

The present invention further relates to uses of the aromatic compounds according to Formula (I) as defined above for accelerating palladium deposition from any aqueous electroless palladium deposition bath, and/or adjusting the deposition rate to a constant range over the life time of any aqueous electroless palladium deposition bath, and/or reactivating an aqueous electroless palladium deposition bath already used for plating, wherein the deposition rate has dropped in relation to the initial deposition rate.

EXAMPLES

The present invention is further explained by the following non-limiting examples.

General Procedures

Substrates and Pre-Treatment:

Test chips made of silicon covered with a $SiO_2$ layer and having four dies each were used as substrates. Each die had several isolated pads of an aluminum-copper alloy on its surface. The pads had different sizes ranging from 10 μm to 1000 μm in diameter and distances between pads ranged from 20 μm to 1000 μm.

The test chips were already pre-treated by double-zincation. Afterwards, the test chips were nickel plated using an electroless nickel plating bath (Xenolyte Ni MP, product of Atotech Deutschland GmbH) containing a nickel(II) salt, a reducing agent for nickel ions, a complexing agent for nickel ions and a stabilizer. The nickel plating bath had a pH value of 4.5 and was held at 87° C. during plating. The test chips were immersed into the nickel plating bath for 10 minutes and a nickel layer of 3 μm thickness was plated onto the test chips. Afterwards, the test chips were rinsed in deionized water and subjected to a palladium plating bath.

Palladium Plating Bath Matrix and Palladium Plating:

A plating bath matrix (Xenolyte Pd LL, product of Atotech Deutschland GmbH) having a pH-value of 5.5 and comprising water, palladium ions, sodium formate as reducing agent for palladium ions and ethylene diamine as complexing agent for palladium ions was used throughout all examples. Sodium formate of different manufacturing batches having different purities was used in the examples.

Different amounts of the aromatic compounds according to Formula (I) of the present invention were added to 2 l of individual palladium plating bath matrices throughout examples 1 to 4. The aqueous plating bath compositions were held at 55° C. during plating. The substrates were immersed into the aqueous plating bath compositions for 6 minutes. Afterwards, the substrates were rinsed with deionized water for 1 minute and dried with air pressure.

Determining the Deposition Rate:

The thickness of the palladium layers deposited in various aqueous plating bath compositions tested was determined with an X-ray fluorescence method (XRF; Fischer, Fischerscope® X-Ray XDV®-11). The thickness was measured on four palladium pads for each substrate. The deposition rate for each aqueous plating bath composition was calculated by dividing the measured thickness of the palladium layers deposited by the plating time of 6 minutes. The mean values of deposition rates for each substrate are presented in Examples 1 to 4 below.

Example 1: According to Invention 0 to 10 mg/l of 4-Cumylphenol were added to the plating bath matrix. The plating bath matrix contained sodium formate of manufacturing batch 1 having highest purity. The aqueous plating bath compositions and plating results are summarised in Table 1 and shown in FIG. 1.

TABLE 1

Deposition rate of aqueous plating bath compositions containing 4-Cumylphenol

| | Concentration of 4-Cumylphenol [mg/l] | Deposition rate [nm/min] |
|---|---|---|
| comparative | 0 | 24.5 |
| according to | 1 | 36.1 |
| invention | 10 | 48.0 |

Figure 2:
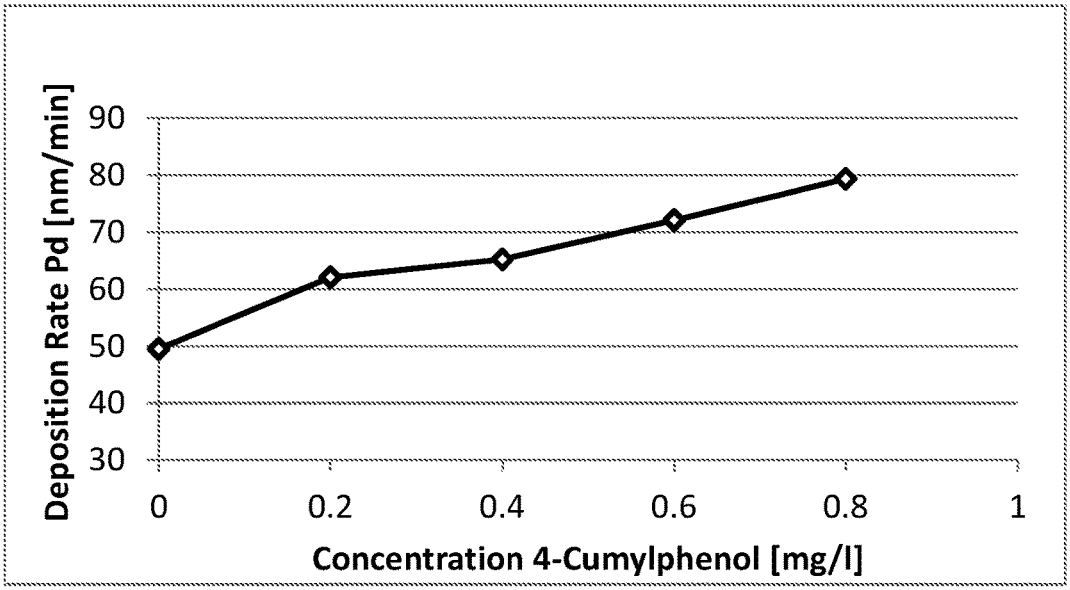
FIG. 2 shows the deposition rate of an aqueous plating bath composition containing 4-cumylphenol in a concentration range of 0.2 to 0.8 mg/l.

Example 2: According to Invention 0 to 0.8 mg/l of 4-Cumylphenol were added to the plating bath matrix. The plating bath matrix contained sodium formate of manufacturing batch 3 having lower purity. The aqueous plating bath compositions and plating results are summarised in Table 2 and shown in FIG. 2.

TABLE 2

Deposition rate of aqueous plating bath compositions containing 4-Cumylphenol

| | Concentration of 4-Cumylphenol [mg/l] | Deposition rate [nm/min] |
|---|---|---|
| comparative | 0 | 49.6 |
| according to | 0.2 | 62.1 |
| invention | 0.4 | 65.3 |
| | 0.6 | 72.1 |
| | 0.8 | 79.4 |

Figure 3:
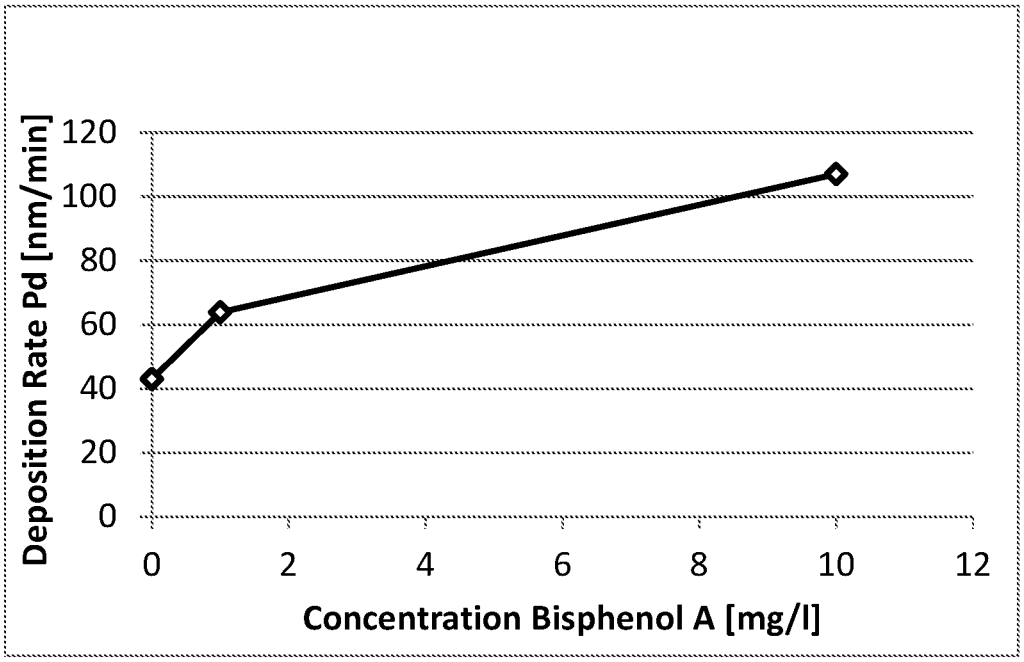
FIG. 3 shows the deposition rate of an aqueous plating bath composition containing Bisphenol A.

Example 3: According to Invention 0 to 10 mg/l of Bisphenol A were added to the plating bath matrix. The plating bath matrix contained sodium formate of manufacturing batch 3 having lower purity. The aqueous plating bath compositions and plating results are summarised in Table 3 and shown in FIG. 3.

TABLE 3

| Deposition rate of aqueous plating bath compositions containing Bisphenol A | | |
|---|---|---|
| | Concentration of Bisphenol A [mg/l] | Deposition rate [nm/min] |
| comparative | 0 | 43 |
| according to | 1 | 64 |
| invention | 10 | 107 |

Summary of Results

Examples 1 to 3 showed that the deposition rate of aqueous plating bath compositions containing aromatic compounds according to Formula (I) were higher compared to compositions lacking the aromatic compounds. The deposition rate increased with increasing concentration of the aromatic compounds. The deposition rates for compositions having no aromatic compounds contained therein (comparative compositions of Examples 1 to 3) differ from each other due to the different batches of sodium formate used therein.

The deposits obtained from aqueous plating bath compositions with or without aromatic compounds according to Formula (I) had a purity of 98 to 99.99 wt.-%, were ductile, had a grey to white colour and adhered very well to the substrates.

The invention claimed is:

1. An aqueous plating bath composition for electroless deposition of palladium, comprising (i) at least one source for palladium ions, (ii) at least one reducing agent for palladium ions, and (iii) at least one aromatic compound according to Formula (I)

Formula (I)

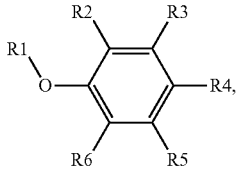

wherein R1 is selected from the group consisting of —H, —$CH_3$, and —$CH_2$—$CH_3$; and wherein R4 is selected from the group consisting of a substituted, linear C1 to C8 alkyl group; unsubstituted or substituted, branched C3 to C8 alkyl group; and an unsubstituted or substituted carbonyl group; and wherein R2, R3, R5, and R6 are selected independently from each other from the group consisting of —H; unsubstituted or substituted, linear C1 to C20 alkyl group; unsubstituted or substituted, branched C3 to C20 alkyl group; —OH; —O—$CH_3$; —O—$CH_2$—$CH_3$; and —$CH_3$, and wherein the unsubstituted or substituted carbonyl group of R4 is selected from moieties according to —$(CR7R8)_n$-CO—$(CR9R10)_m$-R11; wherein R7, R8, R9, R10 are selected independently of each other from —H, —$CH_3$, —$CH_2$—$CH_3$, —OH, —O—$CH_3$, —O—$CH_2$—$CH_3$;

wherein R11 is selected from —$CH_3$, —$CH_2$—$CH_3$, —O—$CH_3$, —O—$CH_2$—$CH_3$, an unsubstituted or substituted phenyl group and an unsubstituted or substituted naphthyl group; and wherein n, m are integers selected independently of each other from 0, 1 and 2, and wherein the at least one aromatic compound according to Formula (I) has a concentration ranging from 0.01 to 50 mg/l.

2. The aqueous plating bath composition according to claim 1, wherein the linear C1 to C8 alkyl groups, the linear C1 to C20 alkyl groups, the branched C3 to C8 alkyl groups or the branched C3 to C20 alkyl groups are substituted and the substituents are selected independently from each other from an unsubstituted or substituted phenyl group and an unsubstituted or substituted naphthyl group.

3. The aqueous plating bath composition according to claim 2, wherein the phenyl group or the naphthyl group are substituted and the substituents are selected independently from each other from the group consisting of —OH, —O—$CH_3$, —O—$CH_2$—$CH_3$, —$CH_3$, and —CHO.

4. The aqueous plating bath composition according to claim 1, wherein

R4 is selected from the group consisting of

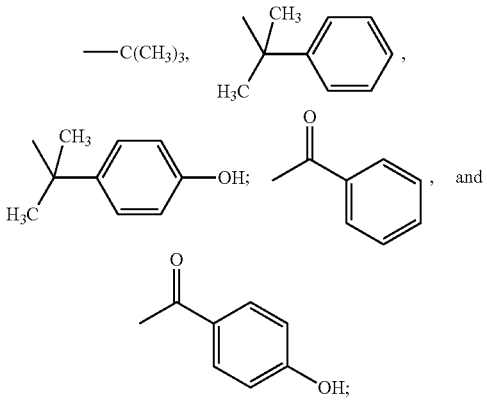

and wherein R2, R3, R5, and R6 are selected independently from each other from the group consisting of

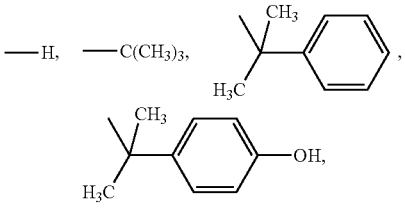

—OH; —O—$CH_3$; and —O—$CH_2$—$CH_3$; and wherein R1 is selected from the group consisting of —H, —$CH_3$, and —$CH_2$—$CH_3$.

5. The aqueous plating bath composition according to claim 1, wherein the at least one aromatic compound according to Formula (I) has a concentration ranging from 0.01 to 20 mg/l.

6. The aqueous plating bath composition according to claim 1, wherein the pH-value ranges from 4 to 7.

7. The aqueous plating bath composition according to claim 1, wherein the at least one source for palladium ions is selected from the group comprising palladium chloride, palladium acetate, palladium sulfate, palladium perchlorate, dichloro ethane-1,2-diamine palladium, diacetato ethane-1,2-diamine palladium; dichloro $N^1$-methylethane-1,2-diamine palladium; diacetato $N^1$-methylethane-1,2-diamine;

dichloro $N^1,N^2$-dimethylethane-1,2-diamine; diacetato $N^1,N^2$-dimethylethane-1,2-diamine; dichloro $N^1$-ethylethane-1,2-diamine; diacetato $N^1$-ethylethane-1,2-diamine, dichloro $N^1,N^2$-diethylethane-1,2-diamine; and diacetato $N^1,N^2$-diethylethane-1,2-diamine.

8. The aqueous plating bath composition according to claim 1, further comprising at least one complexing agent for palladium ions selected from the group consisting of primary amines, secondary amines and tertiary amines.

9. The aqueous plating bath composition according to claim 1, wherein the mole ratio of the complexing agent for palladium ions and palladium ions in the electroless plating bath ranges from 1:1 to 50:1.

10. The aqueous plating bath composition according to claim 1, wherein the at least one reducing agent for palladium ions is selected from the group consisting of hydrazine, formaldehyde, formic acid, derivatives of the aforementioned and salts of formic acid.

11. The aqueous plating bath composition according to claim 10, wherein the formic acid derivatives are selected from esters of formic acid.

12. The aqueous plating bath composition according to claim 1, wherein the concentration of the at least one reducing agent ranges from 10 to 1000 mmol/l.

13. The aqueous plating bath composition according to claim 2, wherein the at least one aromatic compound according to Formula (I) has a concentration ranging from 0.01 to 20 mg/l.

14. The aqueous plating bath composition according to claim 3, wherein the at least one aromatic compound according to Formula (I) has a concentration ranging from 0.01 to 20 mg/l.

15. A method for electroless palladium plating comprising the steps of (a) providing a substrate, (b) contacting the substrate with the aqueous plating bath composition according to claim 1 and thereby depositing a layer of palladium onto at least a portion of the substrate.

16. The method for electroless palladium plating according to claim 15 wherein the substrate is contacted with the aqueous plating bath composition at a temperature of 30 to 65° C. in step (b).

* * * * *